United States Patent [19]

Saito et al.

[11] Patent Number: 4,897,574

[45] Date of Patent: Jan. 30, 1990

[54] HOT CATHODE IN WIRE FORM

[75] Inventors: Masato Saito; Keiji Fukuyama; Masako Ishida; Keiji Watanabe, all of Kanagawa; Toyokazu Kamata, Kyoto; Kinjiro Sano, Kyoto; Hisao Nakanishi, Kyoto; Ryo Suzuki, Kanagawa, all of Japan

[73] Assignee: Mitsubishi Denki Kabushiki Kaisha, Tokyo, Japan

[21] Appl. No.: 105,668

[22] Filed: Oct. 5, 1987

[30] Foreign Application Priority Data

| | | | |
|---|---|---|---|
| Oct. 7, 1986 | [JP] | Japan | 61-239561 |
| May 18, 1987 | [JP] | Japan | 62-122052 |
| May 18, 1987 | [JP] | Japan | 62-122053 |

[51] Int. Cl.[4] ..... H01J 1/14

[52] U.S. Cl. ..... 313/346 R; 313/345

[58] Field of Search ..... 313/346 R, 345

[56] References Cited

U.S. PATENT DOCUMENTS

| | | | |
|---|---|---|---|
| 1,794,298 | 2/1931 | Just | 252/512 |
| 4,350,920 | 9/1982 | Bertens | 313/346 R |

FOREIGN PATENT DOCUMENTS 0063474 10/1982 European Pat. Off. .

OTHER PUBLICATIONS

Patent Abstracts of Japan, vol. 5, No. 133, Aug. 25, 1981, p. 148.

Patent Abstracts of Japan, vol. 8, No. 70, Apr. 3, 1984, p. 135.

Patent Abstracts of Japan, vol. 10, No. 293, Oct. 4, 1986, p. 66.

*Primary Examiner*—Kenneth Wieder

*Attorney, Agent, or Firm*—Wolf, Greenfield & Sacks

[57] ABSTRACT

A hot cathode in a wire form is useful in a vacuum tube, a CRT or a fluorescent display tube is disclosed. The cathode is composed of a heat-resistant metal in a wire form that holds on it an electron-emitting metal material that is made of 0.2–20 wt % of a rear earth metal oxide in admixture with an alkaline earth metal oxide the balance of which contains at least barium oxide. The reduction of oxide barium to barium as a result of reaction with the cathode wire is so much retarded that an increased emission current will be produced from the cathode not only in its initial operation but also through out its operation.

11 Claims, 4 Drawing Sheets

HOT CATHODE IN WIRE FORM

BACKGROUND OF THE INVENTION

The present invention relates to a hot cathode in a wire form useful in such devices as vacuum tubes, CRTs and fluorescent display tubes.

Various devices employing hot cathodes in a wire form have been proposed and a display device of the panel type is shown schematically in cross section in FIG. 2 (Unexamined Published Japanese Patent Application No. 84744/1985). As shown, this device comprises an insulating substrate 1, a plurality of metallic supports 2 provided on the substrate 1 at given intervals, a cathode wire 3 that holds an electron-emitting material at given intervals to form cathodes **4*b* and which spans said supports 2, control electrodes 5 that are provided on the substrate 1 at positions corresponding to said cathodes 4*b*, a grid electrode 6 that is provided above the cathode wire 3 and which is provided with through-holes 6*a* at positions corresponding to the cathodes 4*b*, and an anode 8 that is placed above said grid electrode 6 and which is coated with a phosphor 7 at positions corresponding to said cathodes 4*b*, said grid electrode 6 and the anode 8** being separated by a given distance in the vertical direction.

The cathode wire 3 is made of tungsten and the cathodes **4*b* are formed of a ternary carbonate of barium, strontium and calcium [$(Ba,Sr,Ca)CO_3$] that is deposited on the surface of the wire 3 by a suitable method such as electrodeposition or coating and which is thermally decomposed to an oxide form [(Ba,Sr,Ca)0] during evacuation of the chamber of the display device. During the thermal decomposition, BaO in the electron-emitting material is reduced to generate excess Ba as a result of the reaction with tungsten in the cathode wire 3** that proceeds according to the scheme shown below, and the generated excess Ba diffuses or otherwise migrates to the surface of each cathode so as to form donors in BaO that contribute to electron emission:

ti $6BaO + W \rightarrow Ba_3WO_6 + 3Ba$ (Reaction Equation 1).

The display device shown in FIG. 2 will operate as follows. When the cathode wire 3 is heated to about 700° C. by supplying power across the wire 3, electrons will be emitted from the surface of cathodes **4*b*. If a positive voltage is applied to the grid electrode 6 and the anode 8, the emitted electron beams will fly through holes 6*a* in the grid to impinge on the phosphor 7 for its excitation. If a negative voltage is applied to the control electrode 5, the electric field around the cathodes 4*b* will become negative to the cathodes 4*b*, thereby stopping electron emission from the cathodes 4*b*. Therefore, the emission of electron beams from the cathodes 4*b* can be controlled by applying a positive pulsive voltage to the control electrode 5**.

In the conventional hot cathodes in a wire form, excess Ba is generated only by the reaction between BaO in the electron-emitting material and a heat-resistant metal, i.e., tungsten. The amount of excess Ba generated by this reaction is too small to avoid the suppression of electron emission by impurity gases. During the heating of the ternary carbonate on the cathode wire for its conversion to an oxide form or during the initial operation of the display device, impurity gases will be liberated from the phosphor 7 and the supports 2 so as to decrease the initial emission current. The supply of Ba also becomes insufficient after prolonged operation and this again leads to a reduced emission current. Further problems with the conventional display device are that it produces a low contrast on account of reduced emission current and that it takes an undesirably long time to completely evacuate the system.

SUMMARY OF THE INVENTION

The principal object of the present invention is to provide a hot cathode in a wire form that produces a sufficiently high initial emission current to impart high contrast to a display device and which shortens and simplifies the fabrication of such a device.

The stated object of the preset invention can be attained by a hot cathode in a wire form that holds on the surface of a heat-resistant metal in a wire form an electron-emitting material that is made of 0.2–20 wt. % of a rare earth metal oxide in admixture with an alkaline earth metal oxide the balance of which contains at least barium oxide.

The object can also be attained by a hot cathode in a wire form that holds on the surface of a heat-resistant metal in a wire form an electron-emitting material which is a mixture containing 0.2–20 wt. % of a rare earth metal oxide and an alkaline earth metal oxide containing barium oxide and calcium oxide, the weight ratio of calcium oxide to the rare earth metal oxide being in the range of 0.02–0.7.

It is also possible to attain the stated object by a hot cathode in a wire form that holds on the surface of a heat-resistant metal in a wire form an electron-emitting material which is a mixture containing 0.2–20 wt. % of a rare earth metal oxide and an alkaline earth metal oxide containing barium oxide, the weight ratio of barium oxide to the rare earth metal oxide being in the range of 0.4–60.

DETAILED DESCRIPTION OF THE INVENTION

In addition to the reaction between tungsten and BaO, the hot cathode in a wire form of the present invention allows part of the rare earth metal oxide in the electron-emitting material to react with the heat-resistant metal (i.e., tungsten). Since excess Ba is generated as a result of these two reactions, the electron-emitting material in the hot cathode is more affectively activated than in the conventional hot cathode in a wire form and this contributes not only to a larger initial emission current but also to a reduced amount of drop in the emission current that is produced after prolonged operation.

In the electron-emitting material which is used in the hot cathode of the present invention, the proportions of calcium oxide and a rare earth metal oxide are appropriately adjusted so that part of the excess Ba generated will be adsorbed on the surface of the rare earth metal oxide to undergo a smaller amount of evaporation from the cathode surface, thereby helping the cathode to exhibit excellent life characteristics. In particular, the electron-emitting material which contains BaO and a rare earth metal oxide in limited proportions will undergo an extremely small level of drop in electron emission even in the presence of impurity gases such as oxygen gas.

Figure 1:
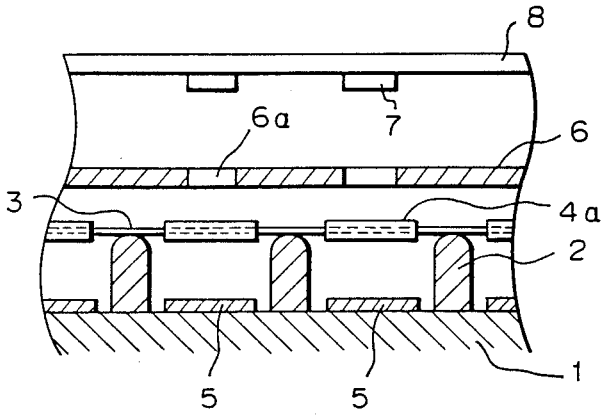
FIG. 1 is a cross-sectional view of a display device employing hot cathodes in a wire form according to one embodiment of the present invention.

FIG. 1 is a cross section showing schematically the essential part of a display device employing hot cathodes in a wire form according to one embodiment of the present invention. In the figure, 1 is a substrate made of a suitable insulator such as a glass or ceramic sheet; 2 signifies a plurality of supports that are typically in the form of metallic projections or ribs; 3 is a cathode wire made of a heat-resistant metal such as tungsten; 4*a* signifies a plurality of cathodes that are formed on the surface of the wire 3 at given intervals along its length; 5 signifies control electrodes; 6 is a grid electrode; and 8 is an anode.

Figure 2:
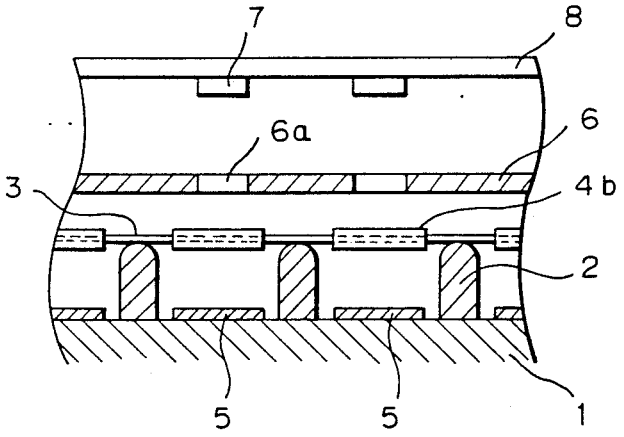
FIG. 2 is a cross-sectional view of a prior art display device.

The supports 2 are provided on the insulating substrate 1 at given intervals; the cathode wire 3 is stretched over the supports 2 in such a way that the cathodes 4*a* will lie between adjacent supports 2; the control electrodes 5 are provided on the substrate 1 at positions where they face the cathodes 4*a;* above the wire 3 is provided the grid electrode 6 that has through-holes 6*a* at positions that face the cathodes 4*a;* above the grid electrode 6 is provided the anode 8 that is coated face the cathodes 4*a*. The anode 8 is separated from the grid electrode 6 by a given distance in the vertical direction. The display device shown in FIG. 1 is essentially the same in construction as the prior art system of FIG. 2 except for the cathodes 4*a*.

EXAMPLE 1

Plating baths with various concentrations of $Sc_2(CO_3)_3$were prepared. Using these baths, cathodes 4*a* having layers of an electron-emitting material coated in a thickness substantially equal to that employed in the prior art (8 μm) were produced by conventional procedures of electrodeposition. The cathodes were assembled in display devices and heated during the step of their evacuation so as to convert $(Ba,Sr,Ca)CO_3$—$Sc_2(CO_3)_3$ to $(Ba,Sr,Ca)O$—$Sc_2O_3$.

Figure 3:
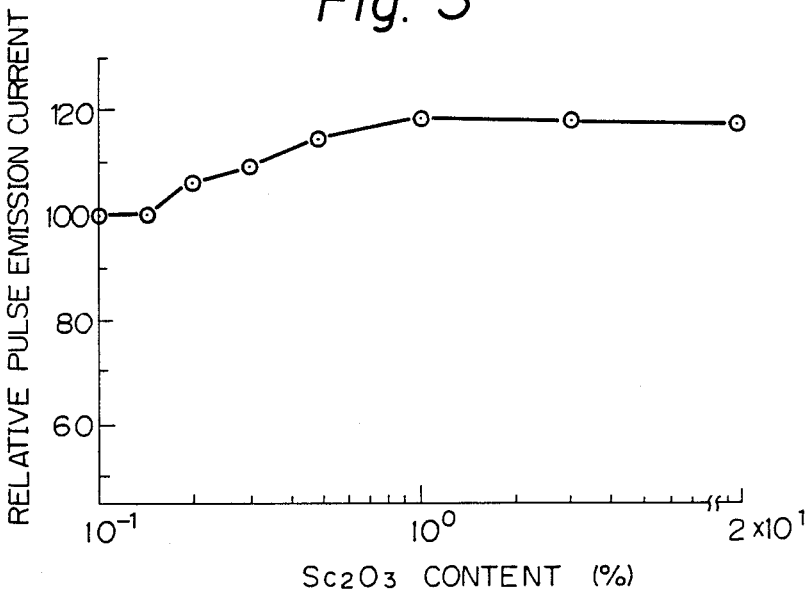
FIG. 3 is a characteristic diagram showing the relationship between the content of $Sc_2O_3$in an electron-emitting material and the pulse emission current.

The completed display devices were operated for 2 hours and the pulse emission current for a given filament current was measured as a function of $Sc_2O_3$ content. The results are shown in FIG. 3. In the graph of FIG. 3, the x-axis indicates the concentration of $Sc_2O_3$ (wt. %) in $BaO$-$SrO$-$CaO$-$Sc_2O_3$, and the y-axis indicates the pulse emission current in terms of a relative value, with the value for the prior art device taken as 100. As is clear from FIG. 3, a significant increase in emission current was observed when the content of $Sc_2O_3$ was 0.2 wt. % and upward and a particularly large emission current was produced for a $Sc_2O_3$ content of 1 wt. % and upward. However, when the $Sc_2O_3$ content exceeded 20 wt. %, the electron-emitting material desorbed from the cathode wire 3 to cause troubles in practical service.

Two types of display device were fabricated and their constructions were entirely the same except for cathodes; the cathodes in one type of display device had a coating of an electron-emitting material containing 5 wt. % $Sc_2O_3$ in accordance with the present invention, and those in the other type of display device had a coating of the conventional (Ba, Sr, Ca). The phosphor layer in each device was made of a phosphor for low-energy electrons, namely ZnO:Zn, and it was composed of several circular patterns each having a diameter of 4.0 mm.

Figure 4:
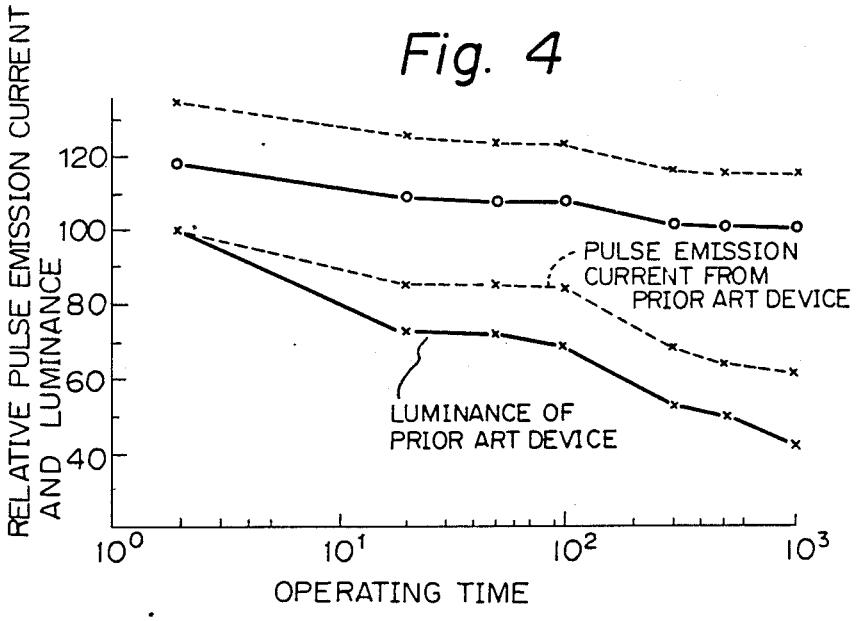
FIG. 4 is a characteristic diagram showing the relationship between the operating time of a display device, luminance and the pulse emission current.

Five specimens of each type of display device were prepared and lit under the same conditions of filament, anode and grid voltages. The luminance of the phosphor layer in each specimen was measured and the average plotted in FIG. 2 in terms of a relative value, with the average luminance for 2-hour operation of the conventional device being taken as 100. At the same time, the pulse emission current from each specimen was measured as a function of the operating time under the same conditions as those employed in obtaining the data shown in FIG. 3, and the results are also shown in FIG. 4 in terms of a relative value, with the average value for 2-hour operation of the conventional device being taken as 100. The initial luminance of the device of the present invention for 2-hour operation was 18% higher than the value for the conventional device. As is clear from FIG. 4, the device fabricated in accordance with the present invention exhibited better characteristics in terms of both luminance and emission current for prolonged operation ranging from the initial stage up to 1000 hours of operation. The superior characteristics of the device were particularly noticeable as compared with the conventional system that experienced a marked drop in both luminance and pulse emission current after several hundred hours of operation. When the phosphor layer in each device was analyzed with an X-ray microanalyzer after 1000 hours of operation, a greater amount of Ba was detected in the conventional device than in the device of he present invention and this would indicate that the superior characteristics of the latter is due to the less consumption of Ba during the operation of the device. As shown above, the display device employing hot cathodes in a wire form that are prepared in accordance with the present invention not only produces a high initial luminance but also offers a high residual luminance after prolonged operation, and this affords practical advantages such as applicability of the display device at high light levels.

While the exact reason for the occurrence of such a phenomenon in the present invention is not completely clear, a plausible explanation would be as follows. In the prior art hot cathode in a wire form, the electron-emitting material reacts with tungsten in the cathode wire 3 to generate excess Ba according to the already noted Reaction Equation 1 and the generated excess Ba diffuses or otherwise migrates to the surface of the cathode to form donors in BaO that contribute to electron emission. This is not the case in the cathode prepared in accordance with the present invention. As noted by the following Reaction Equation 2, the cathode wire 3 reacts with part of $Sc_2O_3$ to form metallic Sc, which then reacts with BaO to generate excess Ba. As a result, the concentration of donors in BaO is sufficiently increased to produce a higher initial emission current and the supply of Ba is maintained even after prolonged operation so as minimize the drop in electron emission:

$$4Sc_2O_3+3W \rightarrow Sc_2W_3O_{12}+6Sc$$

$$3BaO+2Sc \rightarrow Sc_2O_3+3Ba \qquad \text{(Equation 2).}$$

While the first embodiment of the present invention has been described with reference to the case where $Sc_2O_3$ is used as a rare earth metal oxide, it should be noted that similar effects are attained by using other rare earth metal oxides.

EXAMPLE 2

In accordance with another embodiment of the present invention, the cathode 4*a* is made of an electron-emitting material that is a mixture of 0.2–20 wt. % of a rare earth metal oxide and an alkaline earth metal oxide the balance of which contains at least barium oxide and calcium oxide. The weight ratio of calcium oxide to the rare earth metal oxide ranges from 0.02 to 0.7, preferably from 0.04 to 0.3.

Examples of the rare earth metal oxide that can be used include $Sc_2O_3$, $La_2O_3$, $Gd_2O_3$ and $Ce_2O_3$.

The criticality of limiting the weight ratio of calcium oxide to the rare earth metal oxide to be within the range of 0.02–0.7 will become apparent from the following experiment.

Plating baths with various concentrations of $Sc_2(CO_3)_3$ were prepared. They contained 75 wt. % BaO, 10 wt. % SrO and 15 wt. % mixture of CaO and $Sc_2O_3$, with the weight ratio of CaO to $Sc_2O_3$ being varied. Using these baths, cathodes 4*a* having layers of an electron-emitting material coated on a cathode wire 3 in a thickness substantially equal to that employed in the prior art (8 μm) were produced by conventional procedures of electrodeposition. The cathodes with varying compositions were assembled in display devices and heated during the step of their evacuation so as to convert $(Ba,Sr,Ca)CO_3$—$Sc_2(CO_3)_3$ to $(Ba,Sr,Ca)O$—$Sc_2O_3$.

Figure 5:
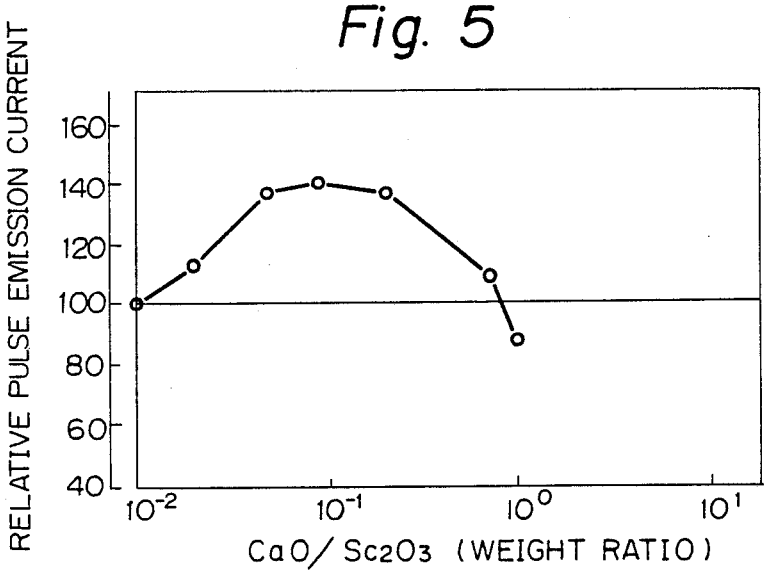
FIG. 5 is a characteristic diagram showing the weight ratio of CaO to $Sc_2O_3$ in an electron-emitting material and the pulse emission current.

The completed display devices were operated for 2 hours and the pulse emission current for a given filament current were measured as a function of the weight ratio of CaO to $Sc_2O_3$. The results are shown in FIG. 5. In the graph of FIG. 5, the x-axis indicates the weight ratio of CaO to $Sc_2O_3$ in the mixture containing BaO, SrO, CaO and $Sc_2O_3$, and the y-axis indicates the pulse emission current in terms of a relative value with the value for the prior art device being taken as 100. As is clear from FIG. 5, a significant increase in emission current was observed when the weight ratio of CaO to $Sc_2O_3$ was in the range of 0.02–0.7. Particularly large emission currents were produced in the $CaO/Sc_2O_3$ range of 0.04–0.3.

Two types of display device were fabricated and their constructions were entirely the same except for cathodes; the cathodes in one type of display device had formed on cathode wires coatings of electron-emitting materials that contained CaO and $Sc_2O_3$ in varying total amounts ($CaO/Sc_2O_3$ fixed at 0.6 in weight ratio) in accordance with the present invention, and those in the other type of display device had a coating of the conventional (Ba,Sr,Ca) in which the weight ratio of SrO to BaO was fixed at 5. The phosphor layer in each device was made of a phosphor for low-energy electrons, namely ZnO:Zn, and it was composed of several circular patterns each having a diameter of 4.0 mm.

Figure 6:
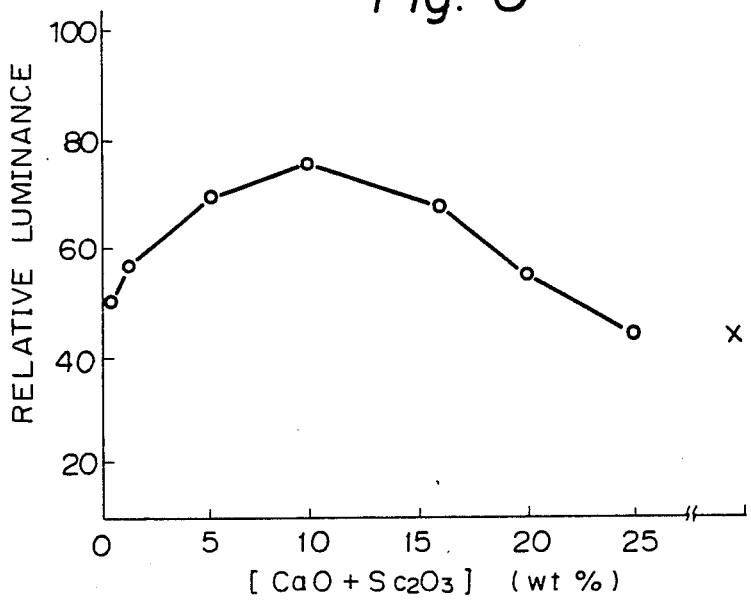
FIG. 6 is a characteristic diagram showing the relationship between the weight percentage of $CaO + Sc_2O_3$ in an electron-emitting material and the luminance of a display device that was operated for 1000 hours.

Five specimens of each type of display device were prepared and operated for 1000 hours under the same conditions of filament, anode and grid voltages. The luminance of the phosphor layer in each specimen was measured and the average plotted in FIG. 6 in terms of a relative value, with the average luminance for 2-hour operation of each of the prior art and invention's device being taken as 100. In the graph of FIG. 6, the x-axis indicates the sum of CaO and $Sc_2O_3$ in wt. % and the y-axis indicates the relative luminance. As is clear from FIG. 6, the specimens fabricated in accordance with the present invention exhibited good luminance characteristics in the $CaO+Sc_2O_3$ range of 1.3–20 wt. % and particularly good results were attained in the range of 4–16 wt. % where the decrease in luminance was minimum. The luminance characteristics of the prior art device are marked X in FIG. 6.

When the phosphor layer in each device was analyzed with an X-ray microanalyzer after 1000 hours of operation, a greater amount of Ba was detected in the conventional device than in the device of the present invention and this would indicate that the consumption of Ba by its evaporation on the phosphor layer during the operation of the device of the present invention was smaller than in the prior art device. It is speculated that the reduced consumption of Ba would be one of the reasons why the device of the present invention successfully maintained high luminance characteristics throughout its operating period.

A plausible reason for the decreased consumption of Ba would be that part of the excess Ba that forms both as a result of reaction between tungsten (i.e., the material of cathode wire 3) and BaO according to Equation 1 and as a result of reaction between tungsten and $Sc_2O_3$ according to Equation 2 is adsorbed on $Sc_2O_3$ to undergo retarded evaporation from the cathode surface. If the weight ratio of CaO to $Sc_2O_3$ is within the range of 0.02/0.7, CaO will serve to supplement the above-described effects of $Sc_2O_3$, thereby affording even better emission characteristics both in the initial period and throughout the service life of the cathode.

As shown above, the display device fabricated in Example 2 not only produces a high initial luminance but also offers a high residual luminance after prolonged operation, and this allows the device to be used even at high light levels.

As an attendant advantage, the display device will exhibit improved life characteristics even if a large current is permitted to flow through the cathode wire 3 with a view to producing high luminance levels.

EXAMPLE 3

In accordance with still another embodiment of the present invention, the cathode 4*a* is made of an electronemitting material that is a mixture of 0.2–20 wt. % of a rare earth metal oxide and an alkaline earth metal oxide the balance of which contains at least barium oxide. The weight ratio of barium oxide to the rare earth metal oxide range from 0.4 to 60, preferably from 0.7 to 30.

Examples of the rare earth metal oxide that can be used include $Sc_2O_3$, $Y_2O_3$ and $Gd_2O_3$. If $Y_2O_3$ is used, the weight ratio of BaO to $Y_2O_3$ is preferably set within the range of 0.9–33; if $Gd_2O_3$ is used, the weight ratio of BaO to $Gd_2O_3$ is preferably set within the range of 1.2–35.

The criticality of limiting the weight ratio of barium oxide to the rare earth metal oxide to be within the range of 0.4–60 will become apparent from the following experiment.

Plating baths with various concentrations of $Sc_2(CO_3)_3$ were prepared. The weight proportions of CaO, SrO, BaO and $Sc_2O_3$in these baths were varied in such a way that the sum of CaO and SrO would be 36 wt. % and that the sum of BaO and $Sc_2O_3$ would be 64 wt. % provided that the weight ratio of BaO to $Sc_2O_3$ was varied. Using these baths, cathodes 4a having layers of an electron-emitting material coated on a cathode wire 3 in a thickness substantially equal to that employed in the prior art (8 μm) were produced by conventional procedures of electrodeposition. The cathodes with varying compositions were assembled in display devices and heated during the step of their evacuation so as to convert $(Ba,Sr,Ca)CO_3$—$Sc_2(CO_3)_3$to $(Ba,Sr,Ca)O$—$Sc_2O_3$.

Figure 7:
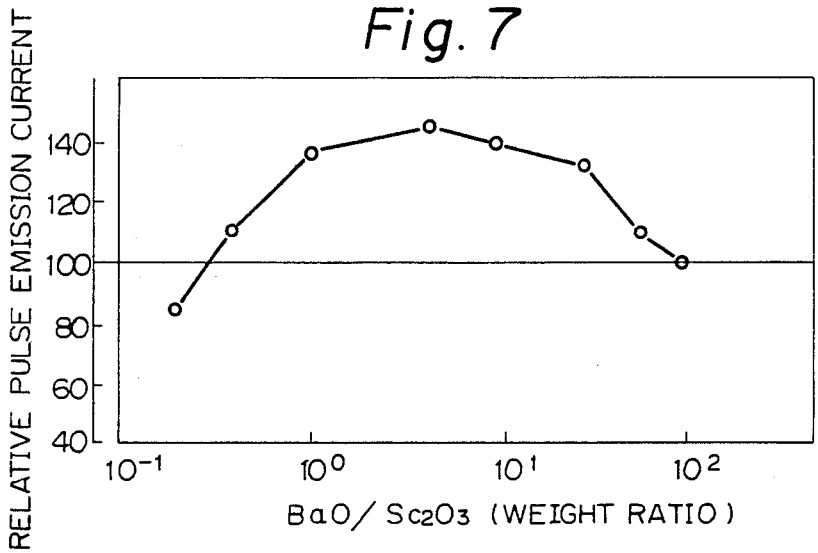
FIG. 7 is a characteristic diagram showing the relationship between the weight ratio of BaO to $Sc_2O_3$ in an electron-emitting material and the pulse emission current.

The completed display devices were operated for 2 hours and the pulse emission current for a given filament current were measured as a function of the weight ratio of BaO to $Sc_2O_3$. Display devices were also fabricated by the prior art technique employing cathodes that were formed of an electron-emitting material in the form of a mixture of 64 wt. % BaO, 32 wt. % SrO and 4 wt. % CaO. The results are shown in FIG. 7. In the graph of FIG. 7, the x-axis indicates the weight ratio of BaO to $Sc_2O_3$ in the mixture containing BaO, SrO, CaO and $Sc_2O_3$, and the y-axis indicates the pulse emission current in terms of a relative value, with the value for the prior art device being taken as 100. As is clear from FIG. 7, a significant increase in emission current was observed when the weight ratio of BaO to $Sc_2O_3$ was in the range of 0.4–60. Particularly large emission currents were produced in the $BaO/Sc_2O_3$ range of 0.7–30.

Figure 8:
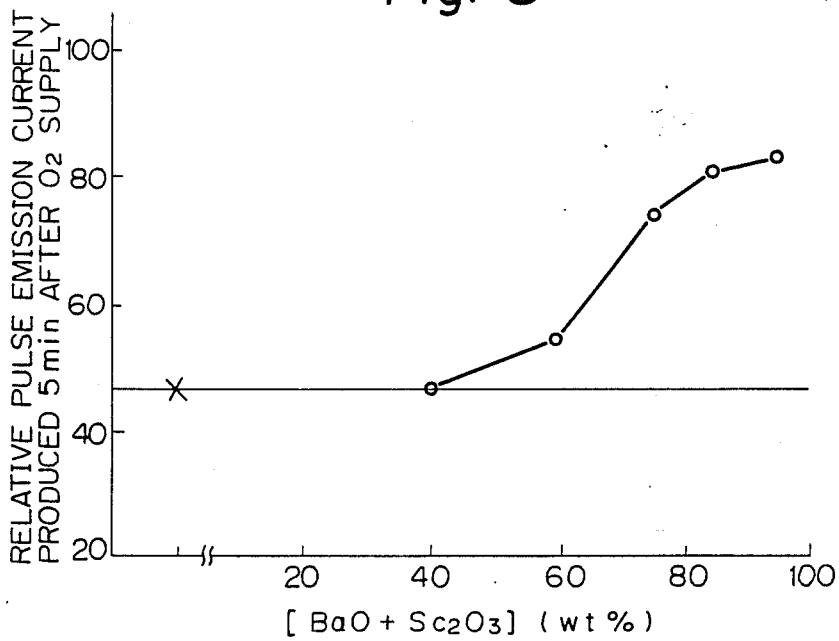
FIG. 8 is a characteristic diagram showing the relationship between the weight percentage of $BaO + Sc_2O_3$ in an electron-emitting material and the pulse emission current produced 5 minutes after the supply of oxygen gas.

The two types of cathodes, one being the product of the present invention and the other being a prior art product, were placed in an ultra-high vacuum chamber which was supplied with $O_2$ gas to a pressure of $10^{-8}$ Torr. The pulse emission current was measured both before the supply of oxygen gas and 5 minutes after its supply. The results are shown in FIG. 8, in which the x-axis indicates the weight percentage of $BaO+Sc_2O_3$ and the y-axis indicates the 5-minute pulse emission current in terms of a relative value, with the zero-minute value being taken as 100. As is clear from the graph of FIG. 8, the prior art device produced a pulse emission current of 45 whereas the device of the present invention produced a pulse emission current of 55 when the sum of BaO and $Sc_2O_3$ was 60 wt. %, and values higher than 70 when the sum was 75 wt. % and upward. It is therefore clear that the device of the present invention had appreciably improved emission characteristics even in the presence of an impurity gas. This would be explained as follows: if the weight ratio of BaO to $Sc_2O_3$ is within the range of from 0.4 to 60, a sufficient amount of excess Ba is formed as a result of reaction between BaO and tungsten and that between $Sc_2O_3$ and tungsten, and part of the excess Ba is adsorbed on the surface of $Sc_2O_3$ so that evaporation of the excess Ba from the cathode surface will be sufficiently retarded to ensure the production of a high pulse emission current. If the sum of the contents of BaO and $Sc_2O_3$ is wt. % or more, particularly good emission characteristics are exhibited even in the presence of an impurity gas.

The display device described in Example 3 has the following advantages: first of all, it produces a high initial luminance level; secondly, the evacuation step in the manufacture of the device can be shortened; thirdly, the device can be fabricated at low cost; as an attendant advantage, the device will exhibit improved life characteristics even if a large current is permitted to flow through the cathode wire 3 with a view to producing high luminance levels.

The description in the foregoing examples assumes the use of tungsten as the material of a heat-resistant metallic cathode wire but it should be understood that the cathode wire may be made of any other suitable materials and that similar results will be attained by using cathode wires that contain Mo or Ta as the major component. The cathodes employed in Examples 1 to 3 were in a linear form but the same results as described above can be attained even if the cathodes assume other shapes such as a sheet, a coil or a spiral. The foregoing description also assumes that the hot cathode of the present invention is applied to a panel-type display device but it should of course be understood that this cathode can also be applied to a fluorescent display tube, a CRT, an electron microscope or a fluorescent lamp.

As will be understood from the foregoing description, the hot cathode in a wire form of the present invention produces a large emission current in the initial period of its operation and at the same time, it affords good emission characteristics during its operation. Therefore, this cathode serves to provide a high-contrast display device or a high-performance electron tube.

What is claimed is:

1. A hot cathode in a wire form that holds an electron-emitting material on the surface of a heat-resistant metal in a wire form that contains at least one of tungsten, molybdenum and tantalum as a major component, said electron-emitting material being a mixture containing 0.2–20 wt. % of a rare earth metal oxide and an alkaline earth metal oxide containing barium oxide and calcium oxide, the weight ratio of calcium oxide to the rare earth metal oxide being in the range of 0.02–0.7.

2. A hot cathode in a wire form according to claim 1 wherein the sum of the rare earth metal oxide and calcium is in the range of 1.3–20 wt. %.

3. A thermionic oxide-coated cathode comprising a heat-resistant metal wire comprising, as a major component, at least one of the group consisting of tungsten, molybdenum and tantalum, and an emissive coating on said wire comprised of metal oxides which substantially consist of a first mixture of rare earth metal oxides and alkaline earth metal oxides, the rare earth metal oxides comprising 0.2–20 wt. % of said first mixture and the alkaline earth metal oxides comprising at least barium oxide.

4. A thermionic oxide-coated cathode as set forth in claim 3 wherein the weight ratio of barium oxide to rare earth metal oxides is in the range 0.4–60.

5. A thermionic oxide-coated cathode as set forth in claim 3 wherein the weight ratio of barium oxide to rare earth metal oxides is in the range 0.7–30.

6. A thermionic oxide-coated cathode as set forth in claim 3 wherein said rare earth metal oxides in said first mixture is selected from the group consisting of: scandium oxide, lanthanum oxide, yttrium oxide, cerium oxide and gadolinium oxide.

7. A thermionic oxide-coated cathode as set forth in claim 3 wherein said rare earth metal oxides comprise yttrium oxide and the weight ratio of barium oxide to yttrium oxide is in the range 0.9–33.

8. A thermionic oxide-coated cathode as set forth in claim 3 wherein said rare earth metal oxides comprise gadolinium oxide and the weight ratio of barium oxide to gadolinium oxide is in the range 1.2–35.

9. A thermionic oxide-coated cathode as set forth in claim 3 wherein said alkaline earth metal oxide in said first mixture is an oxide mixture comprising metal oxides selected from the group consisting of: barium oxide, calcium oxide and strontium oxide.

10. A thermionic oxide-coated cathode as set forth in claim 3 wherein said alkaline earth metal oxides include calcium oxide and the weight ratio of calcium oxide to said rare earth metal oxides is in the range 0.04–0.3.

11. A thermionic oxide-coated cathode as set forth in claim 3 wherein said alkaline earth metal oxides include calcium oxide and said rare earth metal oxides include scandium oxide and the the sum of calcium oxide and scandium oxide to said first mixture is in the range 4–16 wt. %.

* * * * *